US005435708A

United States Patent [19]

Kaun

[11] Patent Number: 5,435,708

[45] Date of Patent: Jul. 25, 1995

[54] NOZZLE HEAD FOR A MELTBLOWING APARATUS

[75] Inventor: Achim Kaun, Neunkirchen-Seelscheid, Germany

[73] Assignee: Reifenhauser GmbH & Co. Maschinenfabrik, Troisdorf, Germany

[21] Appl. No.: 152,033

[22] Filed: Nov. 12, 1993

[30] Foreign Application Priority Data

Nov. 13, 1992 [DE] Germany ..... 42 38 347.1

[51] Int. Cl.[6] ..... B29C 47/00; B29C 47.30

[52] U.S. Cl. ..... 425/72.2; 264/39; 264/169; 264/211.14; 264/518; 425/182; 425/188; 425/192 S; 425/461

[58] Field of Search ..... 425/72.1, 72.2, 466, 425/7, 378.2, 464, 66, 80.1, 182–192 S, 210–232, 461; 65/510, 511, 512, 513, 524, 525, 526; 264/12, 24.14, 555, 518, 169, 39; 19/299

[56] References Cited

U.S. PATENT DOCUMENTS

| | | | |
|---|---|---|---|
| 3,398,429 | 8/1968 | Dickson | 264/176.1 |
| 3,535,187 | 10/1970 | Wood | 19/299 |
| 3,740,797 | 6/1973 | Farrington | 264/518 |
| 3,825,380 | 7/1974 | Harding et al. | 425/72.2 |
| 3,844,097 | 10/1974 | Bobkowicz et al. | 264/103 |
| 3,895,089 | 7/1975 | Goyal | 264/518 |
| 4,137,027 | 1/1979 | Ruger | 425/188 |
| 4,295,809 | 10/1981 | Mikami et al. | 264/12 |
| 4,340,563 | 7/1982 | Appel et al. | 425/72.2 |
| 4,820,142 | 4/1989 | Balk | 425/66 |
| 5,242,290 | 9/1993 | Hiraiwa et al. | 425/188 |
| 5,248,247 | 9/1993 | Rubhausen et al. | 425/72.2 |

FOREIGN PATENT DOCUMENTS

| | | | |
|---|---|---|---|
| 0377926 | 7/1990 | European Pat. Off. . | |
| 49-23259 | 6/1974 | Japan | 19/299 |
| 54-73916 | 6/1979 | Japan . | |

*Primary Examiner*—Jay H. Woo
*Assistant Examiner*—John Robert Abel
*Attorney, Agent, or Firm*—Herbert Dubno

[57] ABSTRACT

To simplify the cleaning and maintenance of a meltblowing head, the lips defining with the spinneret the flowing slits adjusting the row of orifices can be swung away from the spinneret on respective lip guides pivotally connected to respective setback bars. The setback bars can be adjusted and locked in place with respect to the blowing housing and the lips can be adjusted and locked in place relative to the lip guides independently of the swinging action.

8 Claims, 5 Drawing Sheets

NOZZLE HEAD FOR A MELTBLOWING APARATUS

FIELD OF THE INVENTION

The present invention relates to a nozzle head for a meltblowing apparatus and, more particularly, to a nozzle head of the type which comprises a spinneret for at least one row of thermoplastic filaments against which air streams are directed to cool and draw those filaments in the deposition of the filaments to form a nonwoven mat or the like.

BACKGROUND OF THE INVENTION

With a nozzle head of the aforedescribed type, the air which is directed toward the path of the curtain of filaments which descend from the horizontal elongated spinneret effects a cooling of the melt of the thermoplastic synthetic resin as it emerges from each of the orifices to cause the melt to congeal and to draw the congealing filaments. The filaments are collected below the head on a conveyor or the like to form a non-woven mat, web or fleece of the filaments.

A meltblowing process utilizing an apparatus of this type is described in EP 0377 926 A1.

The nozzle head of this apparatus comprises a bar-shaped horizontal spinneret with its orifices in a row along a wedge-shaped, downwardly converging formation, the spinneret or orifice bar or beam being supplied with the thermoplastified synthetic resin as a hot melt.

The spinneret is flanked by two blowing devices, each of which can comprise a housing supplying the blowing air, and means forming blowing slits to either side of the orifice row, training the air toward the curtain of filaments and directing the air along this curtain.

The means forming the nozzle slits can each include a blowing lip defining the blowing slit with the aforementioned formation, the lower ends of the blowing lips having a spacing from the apex and this formation which is referred to as the setback. The setback or offset for a particular application can be the width of the blowing slit.

When the arrangement of EP 0 377 926 A1 is used, the setback generally ranges from a tenth of a mm to several tenths of a mm.

The system of EP 0 377 926 can provide say 100 screws for controlling the thickness of the respective blowing slit and has a number of drawbacks, not the least of which is an inability to conveniently maintain or clean the slits and the region between the lips from particles of the synthetic resin material and other contaminants which may or may not adhere to the various surfaces but tend to accumulate in the very narrow clearances defined between the lips and the wedge-shaped formation. The contaminants tend to produce irregularities in the blowing air flow and the reliability of the apparatus, while also interfering with the uniformity of the product.

OBJECTS OF THE INVENTION

It is, therefore, the principal object of the present invention to provide a nozzle head which is free from the drawbacks of the earlier systems described.

Another object of this invention is to provide a nozzle head for a meltblowing apparatus which facilitates the cleaning and maintenance, especially in the region of the narrow clearances between the lips and the wedge-shaped formations in which the orifices are provided.

Yet another object of the invention is the provision of an apparatus which eliminates the need for repeated adjustment of large numbers of screws for resetting a particular blowing slit width upon cleaning and maintenance such that operation of a multiplicity of adjusting screws is not required for that purpose.

SUMMARY OF THE INVENTION

These objects and others which will become apparent hereinafter are attained, in accordance with the invention in a nozzle head for a meltblowing process and especially for the production of a web of meltblown thermoplastic filaments which comprises:

a bar-shaped horizontal spinneret formed with a multiplicity of nozzle orifices in at least one row in a wedge-shaped formation extending longitudinally of the bar and connected to a supply of thermoplastified synthetic resin; and respective blowing devices adjacent opposite sides of the spinneret, each of the blowing devices including a housing provided with means for supplying blowing air, and means for forming a respective blowing slit connected to the respective means for supplying and directing air against thermoplastified synthetic resin emerging from the orifices, each of the means for forming a respective blowing slit comprising:

a slit-forming lip defining with a flank of the wedge-shaped formation a slit width d, the lips terminating at a setback distance m from an apex of the wedge-shaped formation, a lip guide carrying the respective lip, a setback bar carrying the respective lip guide, each lip guide being swingably mounted by the setback bar on the respective housing for pivotal movement about a respective horizontal pivot axis, means for adjusting a position of each lip along the respective lip guide and fixing the adjusted position of the lip along the respective lip guide, means for adjusting a position of each setback bar with the respective lip guide and the respective lip on the housing to set the setback and for fixing the adjusted position of the setback bar, and means for swinging each lip guide and lip carried thereby about the respective horizontal axis to clear the respective lip from the spinneret for maintenance and cleaning.

According to the invention, the setting of the thickness and the setting of the setback can be effected once as required for a particular synthetic resin material and, especially, upon the initial setup and use of the apparatus, by adjusting the lips with respect to the respective lip guides and the lip guides with respect to their setback bars. The settings are then held fixed.

To effect the maintenance and cleaning operations, only the swinging action of the respective lip guides about the respective horizontal axes relative to the setback bars are required to clear the lips from the region of the orifice formation. During this swinging movement, the settings of the setback and slit width remain unchanged.

As a consequence, maintenance and cleaning can be carried out in a simple manner and without detrimental effect on further use of the apparatus and without need to readjust either the setback or the slit width.

It is especially advantageous to provide some adjustability of the slit width and the setback, especially so that the setback is slightly greater than the slit width, i.e. $m=d+x$, where x is a dimension less than d.

The radius of the swinging movement of the lip guide should be sufficiently long that upon an angular displacement which might vary the thickness of the slit width by an amount y, the setback will also be varied by y (i.e. $m+y$ should correspond to $d+x+y$ where y is of the same order of magnitude as m, d and x).

The changes in the width of the setback slit and in the setback can be very small and lies in general in the range of tenths of a mm. It will be understood that the mounting of the lips, the lip guides and the setback bar should be correspondingly precise and of small tolerances. That also applies to the servodrives and, in general, the drives for positioning the various elements.

According to a feature of the invention, the air supply housings can be provided with insulating jackets.

In this case, the lip guides can have lugs which extend through slits in the jacket and can be engaged by respective drives for effecting the pivotal movement of the lip guides.

The drives can be spindle drives with, e.g. servomotors or hand wheels.

To assure return of the lips to their preset positions after they have been swung away for maintenance and cleaning, the undersides of the lips can have pockets for replaceable shims which can fix setpoint positions of the lips and which can engage abutments on the side walls of the nozzle heads. These shims and abutments can ensure precise positioning of the lips.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
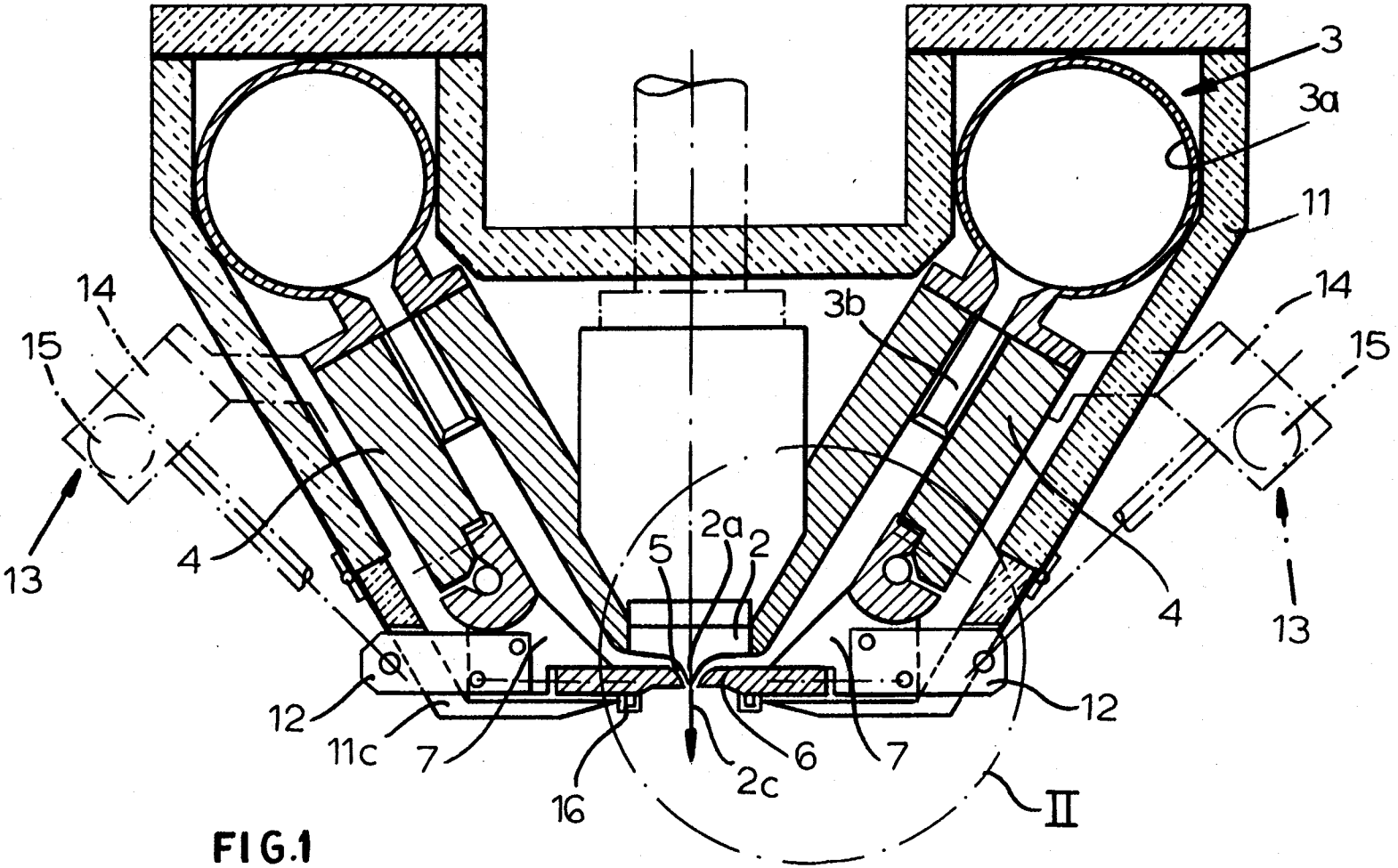
FIG. 1 is a vertical section through a nozzle head embodying the invention.

The nozzle head 1 shown in the drawing is part of an apparatus for the production of a nonwoven fleece or mat of thermoplastic synthetic resin fibers by the melt-blown process, the product being referred to hereinafter as a web.

In that process, below this head, a collecting surface is provided, generally in the form of a conveyor belt and the collected filaments in random loops which may be intertwined, pass between the rolls of a calender to define the ultimate thickness of the nonwoven web.

The head 1 comprises a bar-shaped horizontal plastic nozzle or spinneret 2 having a wedge-shaped formation 2*a* which can be provided with at least one row of orifices 2*b* from which individual filaments pass downwardly in the direction of an arrow 2*c*. The filaments are cooled and drawn by jets of blowing air.

For this purpose, on both sides of the spinneret 2, respective housings 3 are provided, each having a duct 3*a* receiving the compressed cooling air and passages 3*b* delivering that cooling air to slits 5 flanking the nozzle 2 and formed in a housing body 4.

Figure 2:
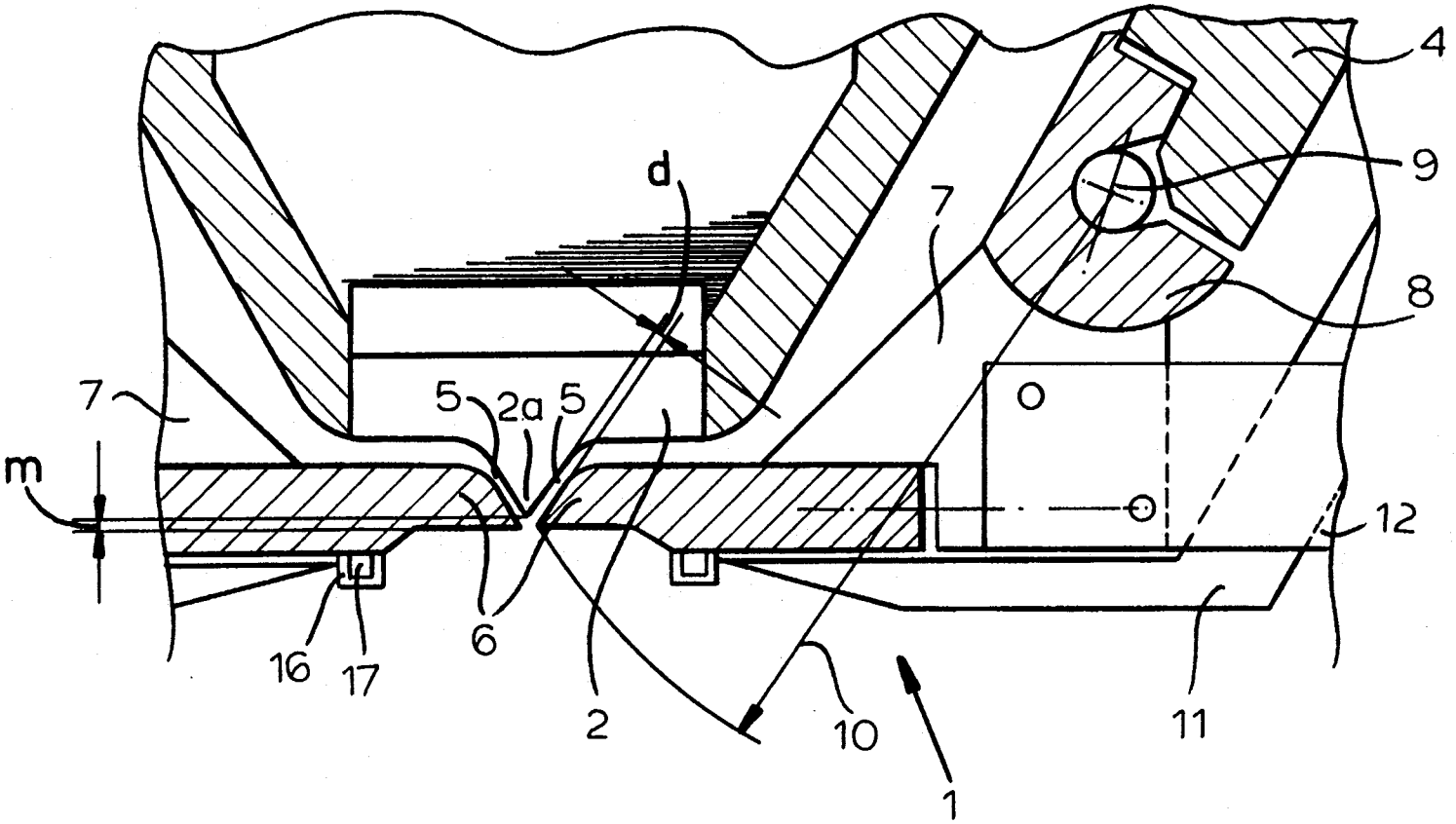
FIG. 2 is a detail in the region of the blowing slits, i.e. the region II of FIG. 1.

Each of the slits 5 is defined between a lip 6 and a flank of the wedge-shaped formation 2*a*. The lips 6 (FIG. 2) have their lower edges at a setback m from the apex of the wedge-shaped formation 2*a*. The width or thickness d of the slit 5 is also represented in FIG. 2 ($d<m$).

Each of the blowing air lips 6 is mounted on a lip guide 7. The lip guides 7, in turn, are swingably mounted on respective horizontal pivot axes 9 on setback bars 8. The setback bars 8 are, in turn, mounted on the housing bodies 4.

According to the invention, each lip 6 is so mounted on its lip guide 7 that it can be adjusted thereof and set on its adjusted position to establish the respective slit width d.

Figure 4:
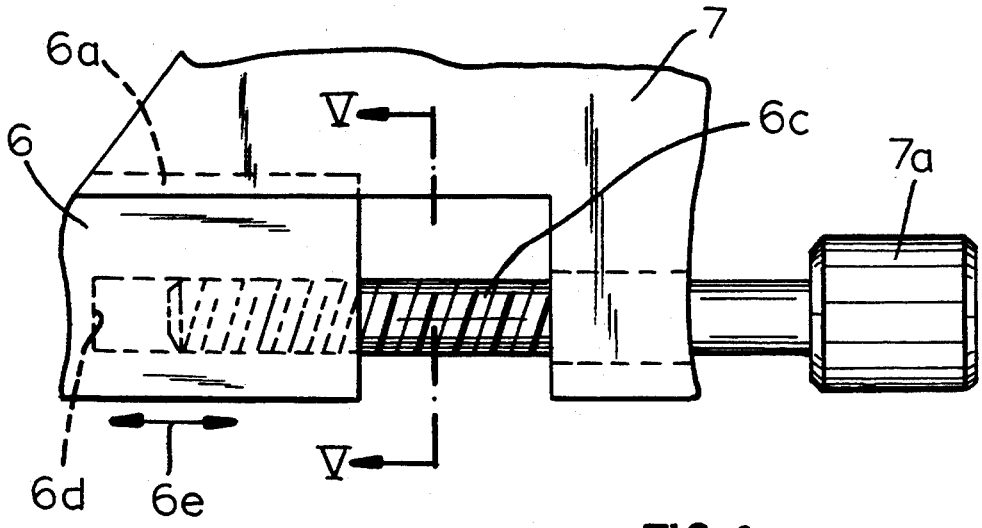
FIG. 4 is a detail of an adjusting device between the lip and lip guide.
Figure 5:
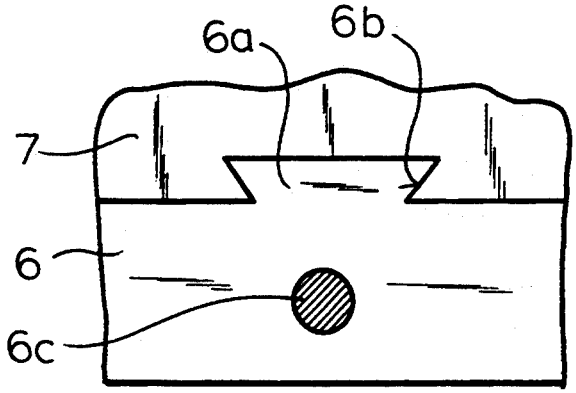
FIG. 5 is a section along the line V—V of FIG. 4.
Figure 7:
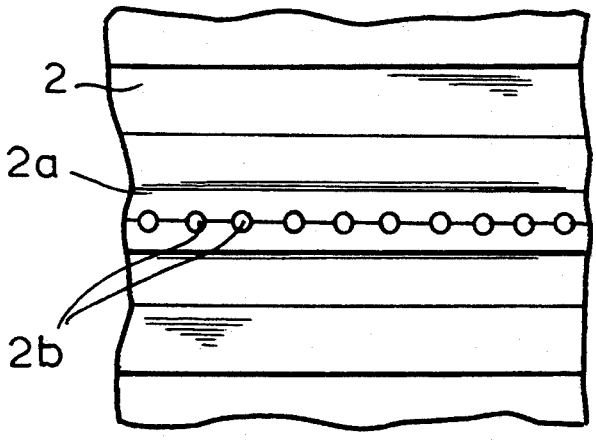
FIG. 7 is a bottom plan view of a portion of the orifice bar or spinneret.

For that purpose, as can be seen in FIGS. 4 and 5, each lip 6 may be provided with dovetail formations 6*a* which are received in dovetail tracks 6*b* of the lip guide 7. Threaded spindles 6*c* can engage in internally threaded bores 6*d* of the lip 6 and can be driven by servomotors 7*a* on the respective lip guide 7 so that the lip is adjustable in the direction of the arrow 6*e* and, when the servomotor 7*a* is de-energized, can be locked in place.

Figure 8:
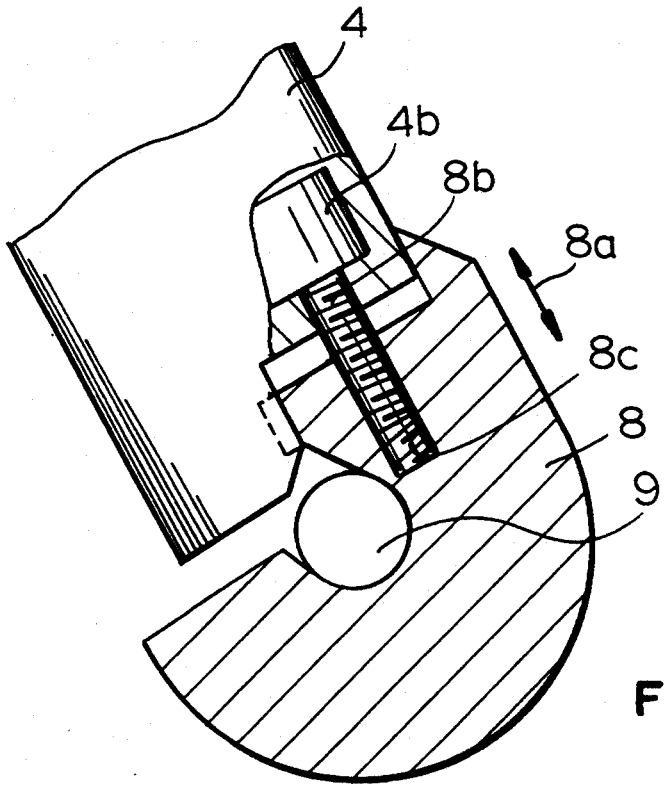
FIG. 8 is a detail section showing the positioning means between a setback bar and the respective housing.

In addition, each of the setback bars 8 can be so mounted on the respective housing body 4 that it can be adjusted and locked in place. For that purpose, the setback bar 8 shown in FIG. 8, together with its pivot shaft 9 and, of course, the lip guide 7 and the lip 6 pivotally mounted on the shaft 9 but not shown in FIG. 8, can be shifted in the direction of the arrow 8*a* by a threaded spindle 8*b* engaging in a threaded bore 8*c* formed in the bar 8, and driven by a servomotor 4*b* in the respective housing 4.

Figure 3:
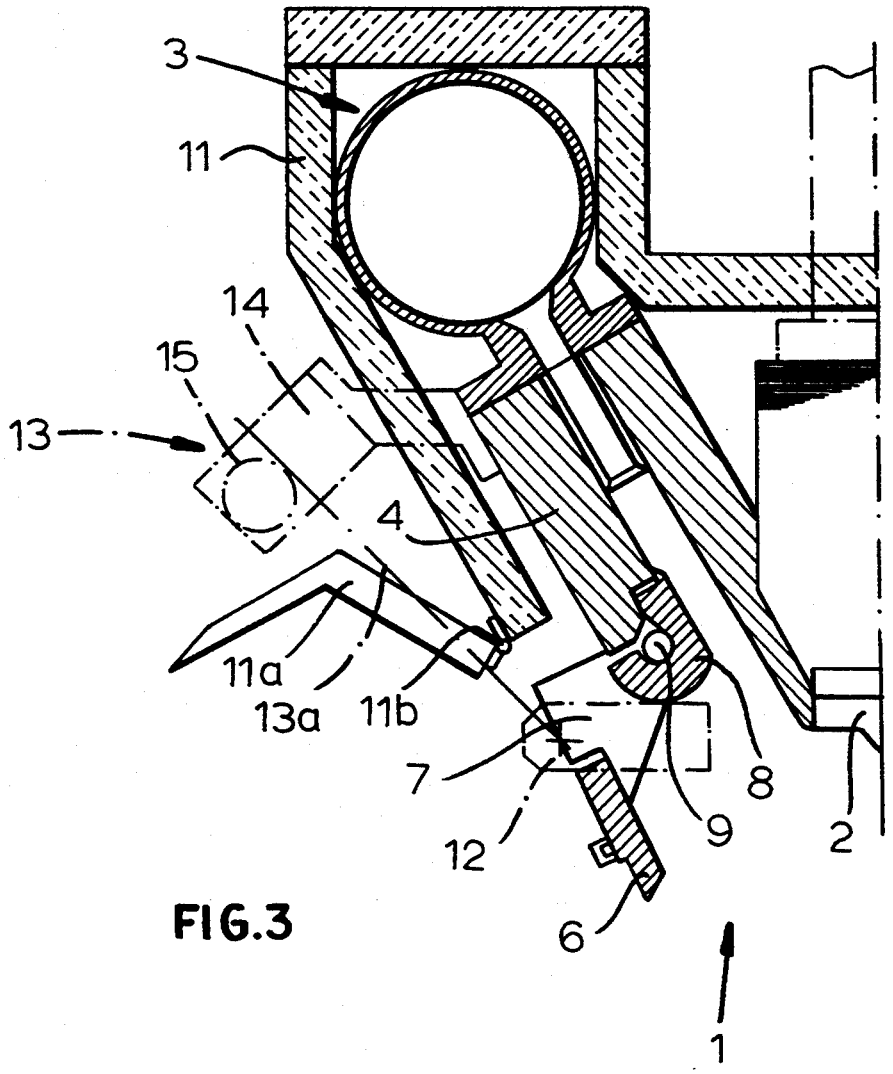
FIG. 3 is a cross section showing the left side of the apparatus of FIG. 1 in the position in which the lip guide is swung away to permit maintenance and cleaning.

The individual lip guide 7 with the respective lip 6 can be swung about the respective horizontal axis 9 at least for maintenance and cleaning work in the region of the nozzle 2 and/or in the region of the slits 5 as shown in FIG. 3.

As can be seen from FIGS. 2 and 3, the slits 5 have a slit width d while the lips define a setback m with the setback m being slightly greater than the slit width d, $m=d+x$, where x is a dimension less than d. In the preferred embodiment of the invention, the axes 9 are so positioned and the radii 10 to the lower edges of the respective lips 6 are of sufficient length that, upon a swinging movement of the respective lip guide which will alter the slit thickness d by an amount y, the setback will also be varied by y. The term "sufficiently long" means that the slit thickness of the slit 5 will not vary substantially in the flow direction upon minor pivotal movements of the lip about the axis of the shaft 9. The relationship thus means that $m+y=d+x+y$.

The housings 4 are enclosed in a thermal insulating jacket 11 and the lip guides 7 can have lugs 12 which pass through slits in the jacket enabling the actuation of the lip guides from a location externally of the jacket. As can be seen from FIG. 3, the portion 11*a* of each jacket underlying the respective lip can be hinged at 11*b* to the balance of the jacket to facilitate the swinging movement for cleaning if desired. The slit is represented at 11*c* in FIG. 1.

The lugs 12 are articulated to a drive 13 which can include a spindle represented at 13*a* which can be driven by a hand wheel 15 or a servomotor 14 as desired.

On their undersides, the lips 6 may be provided with pockets 16 in which replaceable shims 17 can be received. On side walls of the nozzle head, e.g. the side wall 20 shown in FIG. 6, abutments can be provided for the shims to set predetermined positions of the shims to which the shims are returned when the lips 6 are swung back into the filament-blowing positions from the maintenance and cleaning position.

Figure 6:
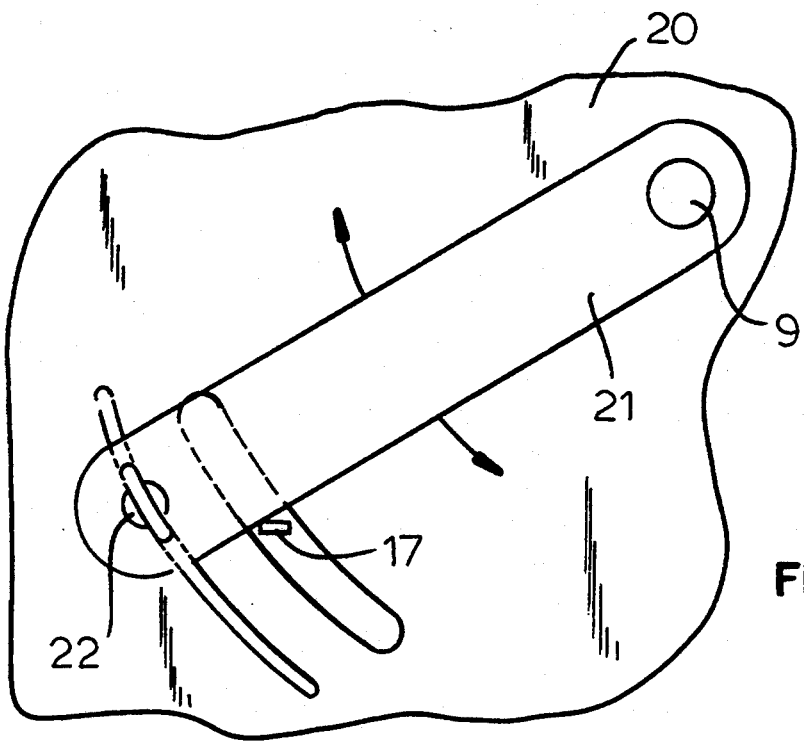
FIG. 6 is an elevational view showing the engagement of a shim with an abutment of an end wall of a housing.

In FIG. 6 the bottom is shown to be a bar 21 swingable about the shaft 9 and adapted to be locked in place by a screw 22 to form a stop for the shim 17 passing through the wall 20.

I claim:

1. A nozzle head for a meltblowing apparatus for the production of nonwoven webs of thermoplastic filament, said nozzle head comprising:

a bar-shaped horizontal spinneret formed with a multiplicity of nozzle orifices in at least one row in a wedge-shaped formation extending longitudinally of the bar-shaped spinneret and connected to a supply of thermoplastified synthetic resin; and respective blowing devices adjacent opposite sides of said spinneret, each of said blowing devices including a housing provided with means for supplying blowing air, and means for forming a respective blowing slit connected to the respective means for supplying and directing air against thermoplastified synthetic resin emerging from said orifices, each of said means for forming a respective blowing slit comprising:

a slit-forming lip defining with a flank of said wedge-shaped formation a slit width d, said lips terminating at a setback distance m from an apex of said wedge-shaped formation, a lip guide carrying the respective lip, a setback bar carrying the respective lip guide, each lip guide being swingably mounted by the setback bar on the respective housing for pivotal movement about a respective horizontal pivot axis, means for adjusting a position of each lip along the respective lip guide and fixing the adjusted position of the lip along the respective lip guide, means for adjusting a position of each setback bar with the respective lip guide and the respective lip on said housing to set the setback m and for fixing the adjusted position of the setback bar, and means for swinging each lip guide and lip carried thereby about the respective horizontal axis to clear the respective lip from the spinneret for maintenance and cleaning.

2. The nozzle head defined in claim 1 wherein $m=d+x$ where x is a magnitude less than m and d, the position of each axis is such that a radius therefrom to the respective lip has sufficient length that a variation of the slit width by a distance y will vary the setback by the distance y and $d+y=d+x+y=m+y$.

3. The nozzle head defined in claim 1, further comprising a thermally insulating jacket for said housing, said lip guides having respective lugs extending through slits in said jacket and connected to a respective drive for angularly displacing the respective lip guide about the-respective axis.

4. The nozzle head defined in claim 3 wherein said drive is a spindle drive.

5. The nozzle head defined in claim 4 wherein said spindle drive is provided with a servomotor.

6. The nozzle head defined in claim 4 wherein said spindle drive is provided with a handwheel.

7. The nozzle head defined in claim 3 wherein said lips are provided with pockets receiving-respective shims defining end positions of said lips, said housings having end walls formed with abutments engaging said shims.

8. The nozzle head defined in claim 1 wherein said lips are provided with pockets receiving respective shims defining end positions of said lips, said housings having end walls formed with abutments engaging said shims.

* * * * *